United States Patent [19]

Walsh

[11] 4,280,076

[45] Jul. 21, 1981

[54] INCANDESCENT LAMP WITH STRUCTURE FOR COLLECTING EVAPORATED FILAMENT MATERIAL

[75] Inventor: Peter Walsh, Stirling, N.J.

[73] Assignee: Duro-Test Corporation, North Bergen, N.J.

[21] Appl. No.: 952,268

[22] Filed: Oct. 18, 1978

[51] Int. Cl.[3] ..... H01K 1/00; H01K 1/26

[52] U.S. Cl. ..... 313/114; 313/222; 313/315

[58] Field of Search ..... 313/207, 206, 315, 222, 313/240, 113, 114

[56] References Cited

U.S. PATENT DOCUMENTS

| | | | |
|---|---|---|---|
| 1,607,515 | 11/1926 | Duncan | 313/222 X |
| 1,899,587 | 2/1933 | Quesseque | 313/222 X |
| 2,151,522 | 3/1939 | Nutto | 313/240 |
| 2,208,987 | 7/1940 | Kuhne et al. | 313/222 X |
| 2,232,816 | 2/1941 | Van Horn | 313/114 X |
| 2,379,058 | 6/1945 | Anderson | 313/240 X |
| 2,467,710 | 4/1949 | Van Horn et al. | 313/240 X |
| 2,494,916 | 1/1950 | Van Horn | 313/222 X |
| 2,799,791 | 7/1957 | Honing et al. | 313/113 X |
| 3,073,986 | 1/1963 | Hodge | 313/222 X |
| 4,160,929 | 7/1979 | Thorington et al. | 313/222 X |

*Primary Examiner*—Palmer C. Demeo
*Attorney, Agent, or Firm*—Darby & Darby

[57] ABSTRACT

An incandescent electric having a filament which incandesces and produces a vapor of the metal of the filament which normally deposits on the envelope wall. Structures are provided adjacent the filament on which vaporized filament material will deposit rather than deposit on the envelope wall where it would reduce the light output of the lamp.

23 Claims, 9 Drawing Figures

INCANDESCENT LAMP WITH STRUCTURE FOR COLLECTING EVAPORATED FILAMENT MATERIAL

Conventional incandescent electric lamps are generally of two types, these being the so-called clear glass envelopes and those with a "frosted" coating. Another type of lamp utilizes a transparent coating which is both reflective to infrared (IR) energy produced by the filament and also transmissive to the visible energy produced.

In lamps of the clear glass type and those with a coating for transmitting visible and reflecting IR energy, a problem is encountered over a certain area of the envelope which is caused by the operation of the filament, this filament generally being of tungsten. That is, after a certain time of operation, usually only a few hundred hours, an amount of material is boiled-off, or vaporized, from the filament and deposited on the wall of the envelope. This darkens or blackens an area of the wall of the envelope and, in this darkened area, the visible light is absorbed and cannot be passed therethrough. This reduces the overall light output efficiency of the lamp and its efficiency. A similar problem is encountered in a frosted type of lamp where the filament material also darkens a part of the wall. In lamps of the IR reflective coating type, the blackening of the wall also reduces the ability of that part of the wall to reflect IR energy back to the filament, thereby decreasing the efficiency of the lamp.

One known type of lamp uses a halogen cycle reaction to prevent wall darkening. That is, a halogen such as iodine or bromine is added to the gas fill. The halogen acts as a scavenger to collect free atoms of the filament material and prevent them from depositing on the envelope. Such halogen cycle lamps however, are relatively expensive and have found only limited use.

To improve the efficiency of an incandescent lamp, it is desired to reduce the effect of the wall darkening by the vaporized filament material. The present invention relates to various structures for accomplishing this. In accordance with the invention one or more structures are mounted within the lamp envelope which act as collectors for the vaporized filament material. A large part of the vaporized material is collected by these structures and is therefore not deposited on the envelope wall.

It is therefore an object of the present invention to provide an incandescent electric lamp having means for collecting material vaporized from the filament.

A further object is to provide an incandescent lamp having one or more conical structures within the lamp located adjacent the filament to collect material vaporized therefrom.

A further object of the invention is to provide an incandescent electric lamp of the clear glass type, having one or more structures for collecting vaporized filament material.

Yet another object is to provide an incandescent lamp with an IR reflective and visible light transmissive coating having one or more structures therein for collecting material vaporized from the filament.

Other objects and advantages of the present invention will become more apparent upon reference to the following specification and annexed drawings in which.

Figure 1:
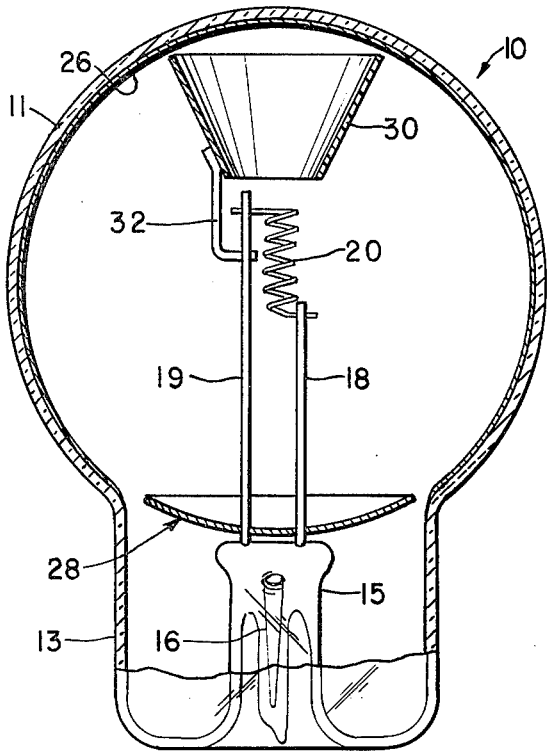
FIG. 1 is an elevational view in cross-section showing an incandescent lamp in accordance with the subject invention.

Referring to FIG. 1, the incandescent lamp 10 of the invention includes an envelope 11 of glass, such as lime glass or borosilicate glass, or other similar material. The envelope is shown as being generally spherical in shape although any other conventional or optically designed shapes, such as an ellipsoid, can be used in accordance with the general concept of the invention. The optical shapes are used where the envelope is to be provided with a mechanism, such as a coating, for reflecting infrared energy back to the filament.

The envelope 11 has a neck portion which is formed with a re-entrant stem 15 having a tubulation 16 thereon. The interior of the envelope 11 is exhausted through the tubulation 16 and then filled with a gas, if this is desired. The lamps of the invention can operate either as a vacuum-type or as a gas filled lamp, for example, with argon or some other conventional type of gas used with incandescent lamps. A high molecular weight gas, such as krypton, also can be used.

Extending from the stem 15 is a pair of lead-in wires 18 and 19, these wires being relatively stiff. The bottom ends of the wires are connected to a base of conventional construction for example, of the screw or bayonet type, to make electrical contact therewith, the base being able to be placed into a socket. The base is not shown for purposes of clarity.

A filament 20 is mounted to the lead-ins 18 and 19. The filament is of any conventional construction. For the purposes of describing the invention, the filament is shown as being of a so-called elongated compact-type, that is, the filament is relatively short in comparison with the overall diameter of the lamp. The filament is also mounted vertically, that is, vertically with respect to the base of the lamp. It also can be mounted horizontally and, further, it can be straight or curved. The filament 20 is normally of tungsten, either plain or doped, and can be single-coil or coiled coil, or triple coiled. The particular shape and material of the filament, in themselves, are not critical to the present invention.

As hereinbefore described, the lamp is of more or less conventional construction. Referring to FIG. 1, is considered to be coated on the internal wall thereof with a coating 26 of an IR reflective material. The particular IR reflective material is not critical to the invention, it merely being used as an adjunct thereof for describing the principles of the invention. As described previously, the invention has an added advantage in the use of the lamp with a coating 26 since if darkening of the coating is prevented, the efficiency of the lamp is maintained by keeping the area of the coating which would normally be darkened free for reflecting IR energy. In the case of a clear glass lamp, a frosted coated lamp and an IR reflecting coated lamp, the darkening caused by the filament material prevents light from being transmitted through the envelope. The invention thus has the advantage of maintaining the light output of these lamps.

A type of IR reflective coating which can be used is shown, for example, in my copending U.S. application Ser. No. 781,355, filed Mar. 7, 1977, now U.S. Pat. No. 4,160,929, granted July 10, 1979, which is assigned to the assignee of this application and, also, in my copending application Ser. No. 863,155, filed Dec. 22, 1977, and now abandoned, which is also assigned to the assignee of the subject application. In general, the filament receives its emitted IR energy which is reflected from the coating 26. The received energy tends to raise the temperature of the filament, thereby reducing the amount of power needed to heat it to its operating temperature. The coating 26 preferably has at least about 60% reflectivity to the IR energy and at least about 60% transmissivity to the visible energy. A reflector 28 is shown located below the filament to reflect back to the filament IR energy which is incident thereon.

Depending upon the shape of the filament and its mounting, there will be an area of the envelope 11 of the lamp which will be blackened due to filament material being evaporated from the filament 20 and deposited on the envelope. In a mounting arrangement of the type shown in FIG. 1, in which the lamp is burned base down, this generally will be a more or less circular area at the top of the lamp above the filament. The size of the circular area depends upon such factors as the filament material, its operating temperature, spacing from the envelope wall and gas fill.

The deposition of the vaporized filament material onto the wall can be reduced by providing a collector surface within the lamp for collecting the material before it reaches the envelope wall. Preferably, to minimize the light lost due to present of the collector surface, the collecting surface should be oriented generally radially to the filament.

The collectors which are described below operate generally in accordance with the following principles:

1. Objects such as collector surfaces, which are aligned generally radially to the filament in a normal (clear glass or frosted) or IR coated lamp do not significantly interfere with the light emitted radially from the filament.
2. At small angles of incidence of light on a surface, including a metal such as tungsten, the metal has a high reflectivity. Thus, any structure radially aligned can act as a collector of the filament material with little degradation of light output even if the light is not quite radial to the surface.
3. A compact filament acts as a radiator that emits light mainly radially if the collector is not located too closely to the filament.

In FIG. 1, the filament material collector is shown as a body 30 in the shape of a cone located above the filament 24 mounted to one of the lead wires 19 by a mounting wire 32. Any suitable mounting arrangement can be used. The cone 30 can be of a suitable metal such as aluminum with a polish, silver, or tungsten, or of a metal or non-metal with a thick metallic coating of, for example, aluminum, silver or tungsten. Any suitable highly refractory material can be used including, for example, Wellsbach material, which has the additional advantage of incandescing at high temperatures to supply additional light from the hot convection stream in the lamp. The material which vaporizes from the filament is collected on both the inner and outer surface of the cone 30 before it reaches the wall of the envelope. Thus, darkening of the envelope wall is prevented. The filament material collected on the cone 30 will leave an essentially smooth metallic surface provided that it does not agglomerate significantly.

The collection process is essentially one of diffusion collection from a convection stream. That is, atoms of the filament metal travel from the filament with relatively low energy. Upon hitting the cone, they come to rest.

Figure 2:
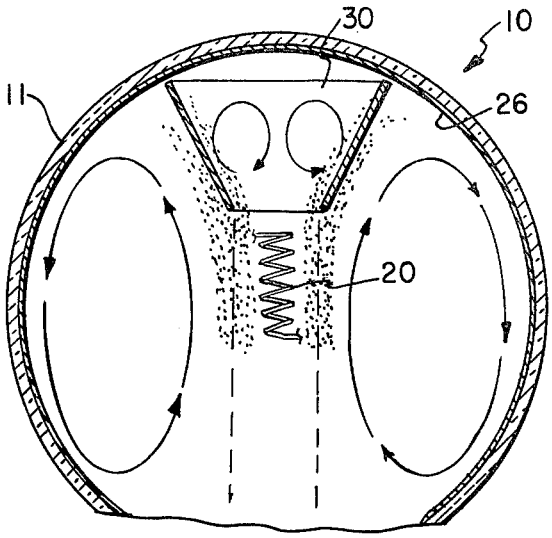
FIG. 2 is a fragmentary view of a portion of the lamp in the area of the filament showing the mechanism by which the filament material is vaporized.

Reference is made to FIG. 2 which shows a greater detail the physical mechanism operating. Near the hot filament 20, the heated vaporized filament material is carried away by diffusion to a distance which is considered, for purposes of analysis, to be the thickness of the Langmuir layer. This thickness depends mainly on the fill gas pressure and the type of fill gas used. In a typical lamp, the fill gas pressure is approximately 200–300 mm/Hg but the invention operates in lamps having fill gas pressures up to atmospheric pressure in which the Langmuir effect still takes place. Beyond the Langmuir layer, heat and filament material is transported by convection to the top of the bulb where it would normally blacken the coating in the case of an IR reflective coating lamp or the envelope wall in the case of clear or frosted glass lamp.

The cone 30 mounted above the filament 20 intercepts the convected filament material and directs it along its surface collecting it. The mouth of the collector is open and has a diameter approximately equal to the Langmuir layer diameter, or somewhat larger. The base of the cone is made somewhat larger than the blackened area which would normally be found at the top of a base down mounted lamp of the same type. The cone angle is made large enough to allow for tilting in the vertical positioning of the cone. In addition, as the cone increases in diameter, with increasing vertical height, the area over which the convected gases move increases with height causing the velocity of the gases to slow down. This produces a more efficient deposition of the filament vapor material for wide cone angles.

As shown in FIGS. 1 and 2, the cone area and angle are sufficient to permit deposition of the vaporized material and allow for reasonable tilting of the lamp while permitting the deposition to take place. The cone should be quite light in weight and, as indicated above, can be mounted on the filament structure. It also can be mounted from the stem or the envelope wall itself.

Figure 2A:
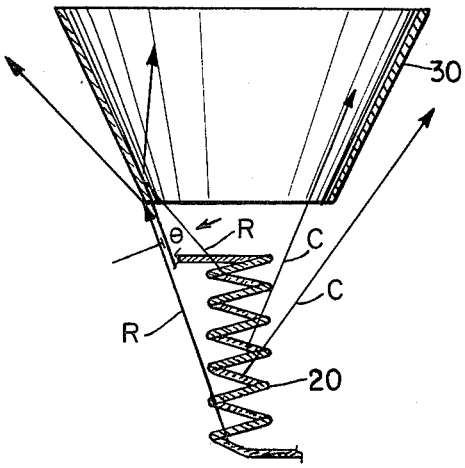
FIG. 2A is a further fragmentary view diagrammatically showing the interaction of the energy emitted by the filament and the collector.

FIG. 2A illustrates how the radiation from a linear filament makes only large angle reflections from the cone 30 if the filament is relatively short and compact. As seen, a central ray C which radiates from the filament will graze the cone or will miss it completely. Rays R from the ends of the filament will be incident upon the cone at a relatively small angle of incidence ($\theta$) and will be reflected from it at relatively small angles of reflection. In the case of a lamp with an IR coating, substantially all of the rays will then be redirected back to the filament to increase its operating temperature. In the case of an uncoated lamp, the visible and IR will be transmitted through the envelope. Thus, the metal vapor deposited on the cone produces very little absorption of visible light or IR energy.

DESCRIPTION OF LANGMUIR LAYER

The diameter, $d_2$ of the Langmuir layer is given by the following equation (Elenbaas, Light Sources, p. 35)

$$d_2 = d_1 \exp(2/Nu)$$

where $d_1$ is the filament diameter and Nu is the Nusselt number, $\alpha d_1/\lambda$, the quantity $\alpha$ being the convection heat loss (cal/sec cm$^2$°K.) and $\lambda$ being the coefficient of thermal conductivity (cal/sec cm°K.).

In a lamp using, for example, krypton gas at 0.63 atmospheres fill pressure, a 1.6 mm diameter for the filament, and a 3200° K. filament temperature, Nu equals 1.16 (H. B. Van Dam & J. R. de Bie, Lighting Research & Technology, Vol. 9, p. 107 (1977)). In this case, $d_2 = 9.0$ mm. thus, the mouth of the cone 30 should have at least this diameter for an opening. With a 40° cone angle the mouth of the cone, if 9.0 mm wide, would be located 12.4 mm above the center of the filament. As is apparent from the foregoing, the dimensions of the cone are varied in accordance with the various parameters of the lamp.

It should be understood that the Langmuir layer analysis is considered only as a guide in designing the cone.

Figure 3:
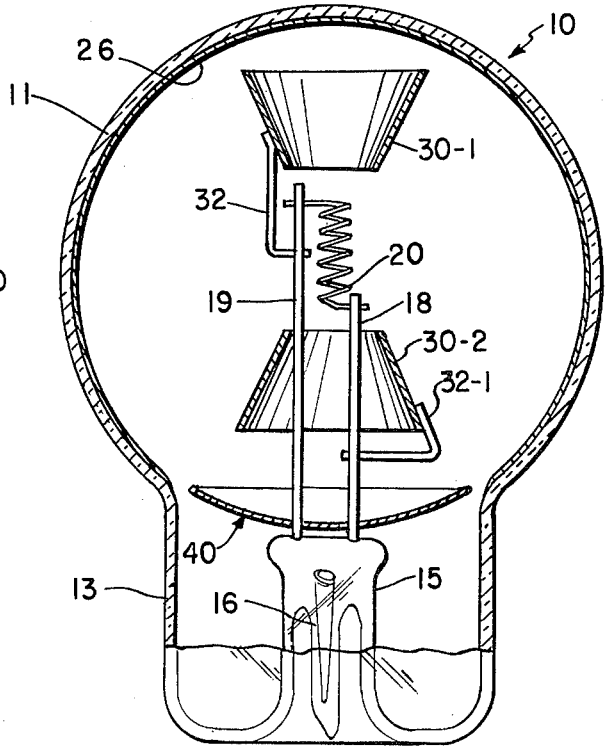
FIG. 3 is an elevational view partly in cross-section showing a modification of the embodiment of FIG. 1.

FIG. 3 shows another embodiment of the invention in which two collector cones 30-1 and 30-2 are used, one on the mount side of the filament and the other on the opposite side. This lamp can be used either in the base down or base up condition.

Figure 4:
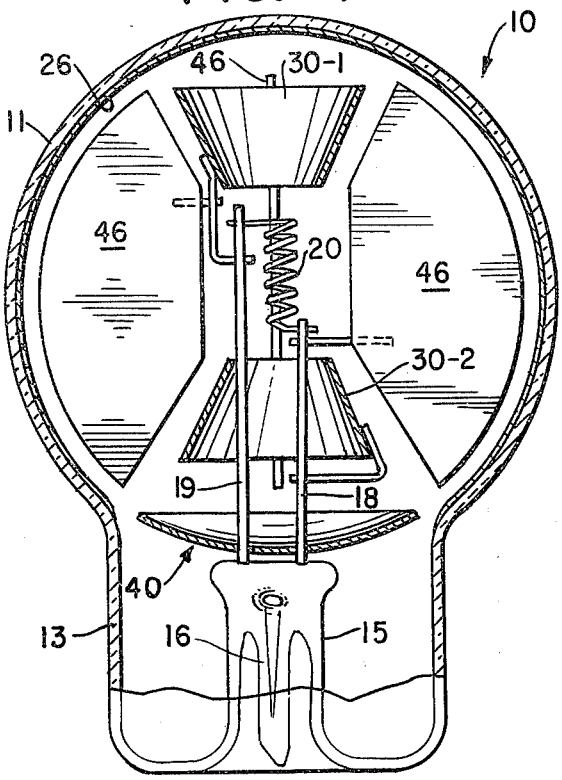
FIGS. 4 and 4A are respectively elevational and top views of another embodiment of the invention.
Figure 4A:
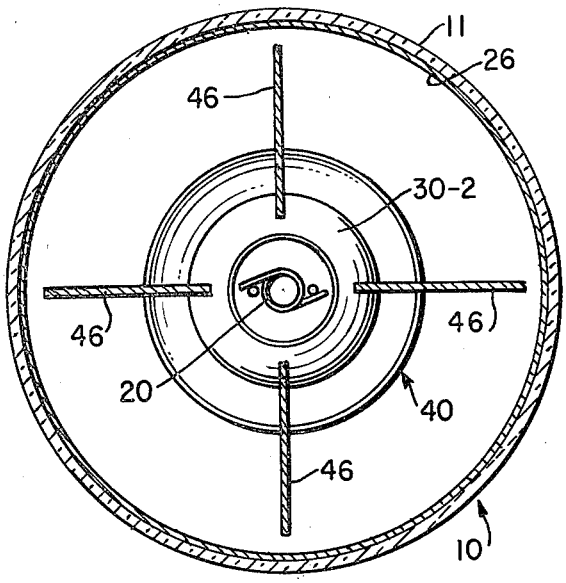

FIGS. 4 and 4A show further embodiments of the invention in which a pair of cones 30-1 and 30-2 are used as in FIG. 3. In addition, planes 46 are placed along various radial angles as collectors. Four such planes 46 are shown and these also are of a suitable metal material such as used for collector 30, preferably one having somewhat of a polished surface. As many of the planes 46 can be used as is needed.

In the structure shown in FIGS. 4 and 4A, the lamp can be mounted in any position. If mounted either vertically base up or base down, then the cones 30 act as the collectors for the vaporized filament material. If the lamp is burned in a horizontal position, then one or more of the planes 46 act as the collectors. If the orientation of the lamp is known in advance, so that direction of difflusion and vaporization is known, one or more of the cones and/or plates can be dispensed with. The filament material collection and light grazing phenomena are as previously described.

An advantage is obtained in extending the cones as in FIGS. 1-3, and the cones and plates, as in FIGS. 4 and 4A, to the walls of the envelope. If this is feasible, then the convection currents within the lamp are curtailed. This reduces both the heat loss and the net amount of filament material evaporated. In essence, the metal atoms of the filament material must diffuse to a collecting surface rather than be carried by convection. The diffusion distance is now larger than the previous Langmuir sheath distance and the rate of diffusion is then smaller.

Thus, a fully enclosing cone and plate structure, such as FIGS. 4 and 4A, will both cut down on the light absorption due to deposited filament material and extend lamp life by reducing net evaporation.

Figure 5:
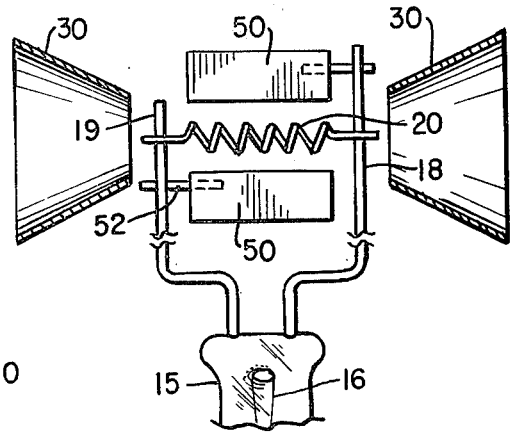
FIGS. 5 and 5A are fragmentary views of further embodiments of the invention.

FIG. 5 is a fragmentary view of another embodiment of the invention shown with a horizontally mounted filament 20. Here, the collector 50 is in the form of a plate which corresponds in some measure to the plates 46 of FIGS. 4-4A. The collector plate 50 is radially of the filament 20. The plate can be fixedly mounted above, in a lamp burned base down, or below, in a lamp burned base up the filament so that the vaporized filament material could be collected. To make a more universally adaptable lamp, with which can be burned either base up or base down, two collector plates 50, one located above and the other below the filament are shown. The plates 50 are of a suitable metal which preferably has a degree of polish, or refractory material including Wellsbah material, as described previously. Each of the plates are mounted to one of the filament lead-ins 18 and 19 by a respective wire 52.

In FIG. 5, there is also shown a collector cone 30 which is mounted at each end of the filament to a respective stem lead 18 or 19. The collector cones operate in the manner described with respect to the cones 30 of the lamps of FIGS. 1-3 when the lamp is burned with the base horizontal, in which case one of the cones would be oriented by screwing in the lamp in the socket, to have its base point up. If the lamp is to be used only in a horizontal position, the plates 50 can be eliminated. Otherwise, the lamp of FIG. 5 can be operated in any orientation.

Figure 5A:
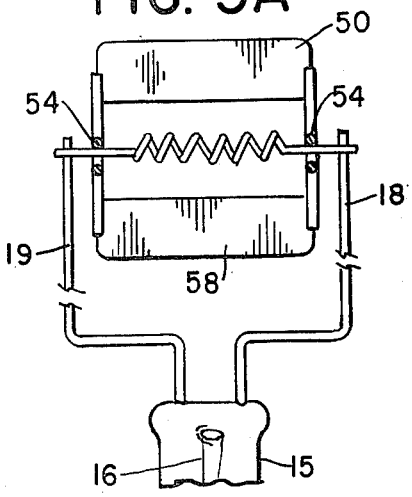

FIG. 5A shows a modification of the lamp of FIG. 5 in which only one collector plate 50 is used in a lamp which can be burned at all positions between base up and base down. Here, the plate 50 has a hinge arrangement in the form of a loop 54 at each end thereof which passes around an end of the filament or an extension of one of the lead-ins 18, 19. The loops 54 are of insulating material or of a metallic material mounted on insulator supports. A counterweight 58 which also can be a metal plate, is attached to the loops 54 and located diametrically opposite plate 50. The counterweight 58 is heavier than collector plate 50. Therefore, depending on which way the base is oriented between base up and base down positions, the counterweight will pivot on loops 54 and cause the collector plate 50 to be above the filament in a position for the metal to be deposited thereon.

Figure 6:
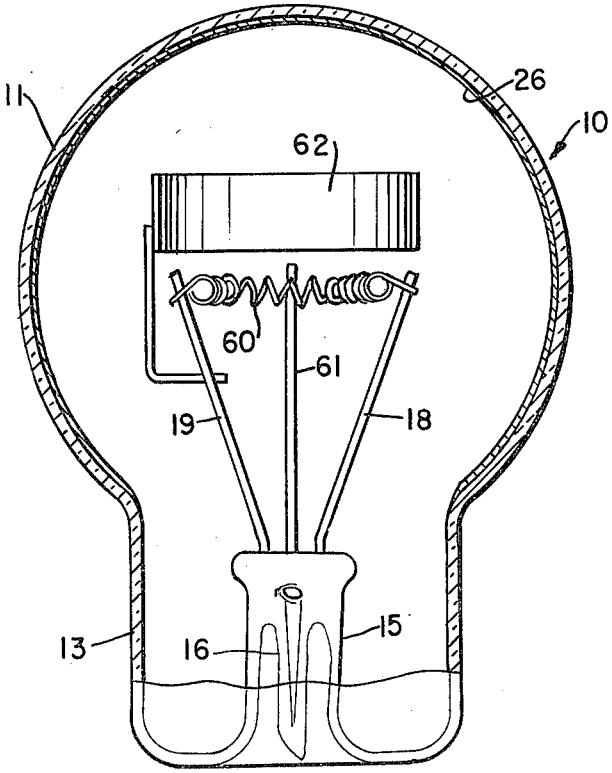
FIG. 6 is an elevational view of yet another embodiment.

FIG. 6 shows yet another embodiment. Here, the filament 60 is generally circular or semicircular and is mounted horizontally with respect to the bulb bse by three support leads 18, 19 and 61. The center support leads is not connected electrically. The collector 62 here is in the form of a plate which is shaped to conform to the shape of the filament. The plate 62 is mounted above the filament and radial to its center line. Collector plate 62 is of any one of the materials previously described. It operates in a generally similar manner to the collector plates 46 of FIGS. 4, 4A.

For a horizontally mounted filament, for example of either of the types of FIG. 5 or 6, a conical collecting body also can be used. In this case, the mouth of the cone would have to have a diameter wider than the largest dimension across the filament.

What is claimed is:

1. An incandescent electric lamp comprising:

an envelope, incandescent filament means located within said envelope, said filament means emitting light in all directions therefrom upon incandescence, material from the filament means being vaporized therefrom which moves by diffusion toward the envelope, means for supplying voltage to the filament means to cause the filament means to incandesce, and means having a continuous and smooth light reflective surface located adjacent a portion of said filament means intermediate the filament means and the wall of the envelope in the diffusion path of the vaporized filament material for collecting material vaporized from the filament means, said collecting means shaped with respect to the portion of the filament means to which it is adjacent so that a substantial portion of the light emitted by said filament means toward said collecting means misses said collecting means and is transmitted to the envelope in the original direction of emission or grazes said collecting means at a small angle of incidence to be reflected to travel toward the envelope.

2. An incandescent electric lamp as in claim 1 wherein said collecting means includes a surface of metal material.

3. An incandescent electric lamp as in claim 1 wherein said collecting means comprises a body of refractory material having a metal film thereon.

4. An incandescent electric lamp as in claim 1 wherein said collecting means comprises a body of refractory material.

5. An incandescent electric lamp as in claim 1 wherein said collecting means comprises Wellsbach material.

6. An incandescent lamp as in claim 1 wherein said collecting means comprises a hollow generally frusto-conical surface with the narrower mouth of the frusto-conical surface lying adjacent to said filament means and the wider base of said surface being closer to the envelope.

7. An incandescent lamp as in claim 6 wherein said filament means is elongated, the mouth of said frusto-conical surface located adjacent an end of the filament means.

8. An incandescent lamp as in claim 7 wherein the lamp envelope has a neck, said filament means being mounted generally vertically of said neck.

9. An incandescent lamp as in claim 7 further comprising a second hollow generally frusto-conical surface having its narrow top located adjacent the other end of said filament means and its base closer to the envelope.

10. An incandescent lamp as in claim 9 wherein the lamp envelope has a neck, the filament means being mounted generally vertically of said neck.

11. An incandescent lamp as in claim 7 wherein the lamp envelope has a neck, said filament means being mounted generally horizontally of said neck.

12. An incandescent lamp as in claim 11 further comprising a second hollow generally frusto-conical surface having its narrow top located adjacent the other end of said filament means and its base closer to the envelope.

13. An incandescent lamp as in claim 1 wherein said collecting means comprises a substantially flat plate.

14. An incandescent lamp as in claim 13 wherein said filament means is substantially straight and is elongated, the plane of said plate located generally radially of, spaced from and parallel to the axis of said elongated filament means.

15. An incandescent lamp as in claim 14 wherein the lamp envelope includes a neck, said filament means located generally horizontally with respect to said neck.

16. An incandescent lamp as in claim 14 further comprising at least one other flat plate collecting means, the plane of which is located generally radially of, spaced from and parallel to the axis of said filament means, said two flat plate collecting means being spaced from one another.

17. An incandescent lamp as in claim 15 further comprising means for mounting said flat plate collecting means to move it to a position on a side of the filament most remote from the neck as the lamp is rotated from a base up to a base down position.

18. An incandescent lamp as in claim 15 wherein there are two said flat plate collecting means, one located above and the other below the filament means.

19. An incandescent lamp as in claim 1 wherein said filament means is substantially straight and is elongated, said collecting means comprising a plurality of substantially flat plates, the plane of each said plate being located generally radially of, spaced from and parallel to the axis of said filament means and spaced therefrom around said filament means.

20. An incandescent lamp as in claim 19 wherein said collecting means further comprises a hollow generally frusto-conical surface at one end of said filament means, the narrow mouth of the frusto-conical surface being located adjacent said end of said filament means.

21. An incandescent lamp as in claim 20 wherein said collecting means further comprises a hollow generally frusto-conical surface at each end of said filament means with the narrow mouth of each frusto-conical surface being located adjacent a respective end of said filament means.

22. An incandescent lamp as in claim 1 wherein said collecting means is located at an angle to said filament means such that rays of energy leaving the filament means will strike the collector means with a relatively small angle of incidence.

23. An incandescent lamp as in claim 1 further comprising means for reflecting back to the filament means a substantial portion of the infrared energy that it produces.

* * * * *